US006907620B2

(12) United States Patent
Sullivan-West

(10) Patent No.: US 6,907,620 B2
(45) Date of Patent: Jun. 21, 2005

(54) BELT LOAD DISTRIBUTION DEVICE

(76) Inventor: Dawn L. Sullivan-West, 853 Garrow St., Newport News, VA (US) 23608

( * ) Notice: Subject to any disclaimer, the term of this patent is extended or adjusted under 35 U.S.C. 154(b) by 235 days.

(21) Appl. No.: 10/252,801

(22) Filed: Sep. 23, 2002

(65) Prior Publication Data

US 2004/0055075 A1 Mar. 25, 2004

(51) Int. Cl.[7] ..... A41F 3/02
(52) U.S. Cl. ..... 2/338; 128/876
(58) Field of Search ..... 2/338, 236, 220, 2/235, 219, 300, 310–328, 920; 602/19, 20, 23; 128/95.1, 96.1, 97.1, 98.1, 99.1, 100.1, 101.1, 102.1, 876

(56) References Cited

U.S. PATENT DOCUMENTS 4,245,628 A * 1/1981 Eichler ..... 602/19
5,147,261 A * 9/1992 Smith et al. ..... 482/106
5,240,156 A * 8/1993 Sicotte et al. ..... 224/583
5,399,151 A * 3/1995 Smith ..... 602/19
5,497,923 A * 3/1996 Pearson et al. ..... 224/639
5,499,965 A * 3/1996 Sanchez ..... 602/19
5,503,620 A * 4/1996 Danzger ..... 602/19
5,820,575 A * 10/1998 Cabrera et al. ..... 602/19
5,984,885 A * 11/1999 Gaylord et al. ..... 602/19

* cited by examiner

*Primary Examiner*—Tejash Patel
(74) *Attorney, Agent, or Firm*—George F. Helfrich

(57) ABSTRACT

A belt load distribution device channels the loads produced by heavy belts, such as gun belts worn by law enforcement officers, away from the user's spine, and distributes the load comfortably across the muscles of the user's back. Heavy belt loads, which typically cause chronic lower back pain in police officers, are significantly mitigated. The belt load distribution device comprises a lower back panel which houses vertical and horizontal stays, and a belt for securing the device around the waist of the user. In addition to alleviating lower back pain caused by the wearing of heavy belts, the device is light, comfortable, durable, adjustable, and easy to maintain.

7 Claims, 4 Drawing Sheets

BELT LOAD DISTRIBUTION DEVICE

BACKGROUND OF THE INVENTION

1. Field of the Invention

The subject invention relates to health equipment, and relates more specifically to the prevention of lower back pain caused by the wearing of heavy belts.

2. Description of the Related Art

Chronic lower back pain resulting from wearing heavy gun/utility belts is a problem commonly suffered by veteran law enforcement officers, although it is not generally known to the public, and often not even discussed within law enforcement organizations themselves. Police departments sometimes have "no light duty" clauses in their employment agreements to protect themselves from liability. If an officer is "not fit for duty," then he can be removed from it, therefore officers are often hesitant to discuss their discomforts. Nevertheless, lower back pain caused by heavy gun belts is quietly recognized among law enforcement officers as a chronic problem, and one for which alleviation would be a welcome relief.

A search of the related art reveals numerous products available for lower back support, especially to prevent injury or discomfort resulting from heavy lifting, bad posture, repetitive motion, strenuous exercise, and the like. Most available products involve some sort of a girdle-like belt that fits snugly about the waist of the user, and applies pressure and support to the muscles and spine to ensure that they remain in their correct positions during strenuous activity. Various products utilize lumbar pads, hot or cold gel packs, and even magnets, to prevent or alleviate lower back pain. Examples of such commercially available products are those sold by the "Relax The Back" company, No products are offered, however, that prevent pain caused by wearing a heavy gun belt, tool belt, or utility belt.

Products which are manufactured specifically for the needs of public safety, law enforcement, and military employees are sold by a commercial sales organization called Galls. Galls is a well recognized supplier of equipment and apparel for the law enforcement industry. In spite of the wide variety of products they offer however, Galls sells no products that prevent chronic lower back pain caused by heavy gun belts.

A variety of patents exist for inventions which mitigate shoulder discomfort resulting from carrying heavy loads supported by a strap over the carrier's shoulder. Several existing patents disclose inventions which apply multiple point pressure loading, sometimes combined with heat or cold, to specific points on the lower back to help heal existing lower back pain. Still other patents disclose belts which provide lower back, lumbar, sacroiliac, and abdominal muscle support, to prevent muscle fatigue caused by heavy lifting, or to help support muscles as they heal from injury.

To date however, no device exists which effectively prevents chronic lower back pain common to those who routinely wear heavy belts, for example law enforcement officers who wear heavy gun belts on a daily basis, construction workers who wear tool belts, and the like.

BRIEF SUMMARY OF THE INVENTION

Accordingly, it is an object of the present invention to provide a belt load distribution device that prevents lower back pain caused by wearing heavy occupational equipment belts.

It is another object of the present invention to provide a belt load distribution device that is comfortable to wear.

It is another object of the present invention to provide a belt load distribution device that is adjustable.

It is another object of the present invention to provide a belt load distribution device that is durable and requires little maintenance.

The present invention is a belt load distribution device that accomplishes the objects above. These and other objects will become more readily appreciated and understood from a consideration of the following detailed description of the exemplary embodiment, when taken together with the accompanying drawings.

The preferred embodiment of the subject invention is a belt load distribution device manufactured from a lightweight, but durable material such as a cotton canvas fabric. The device includes a lower back panel, which houses at least two vertical, substantially rigid stays, and at least one horizontal stay. The vertical stays divert the belt load outwardly away from the user's spine, and distribute the resultant load vertically over the muscles of the back, thereby preventing the deep muscle pain often suffered by law enforcement officers and others who wear heavy belts on a daily basis. Horizontal stays help maintain the shape of the device by preventing the lower back panel from creasing. The lower back panel is situated on the lower back of the user, under clothing and inside the user's heavy, load-bearing belt. The lower back panel is held in place by a strap-like belt, which surrounds the user's waistline and fastens securely to secure the device. The belt, preferably elastic, provides a comfortable means for securing the lower back panel, and is adjustable, accommodating use by those with waistlines measuring from petite to extra, extra large. The belt is fastened using an inexpensive and comfortable yet reliable means, preferably velcro. When the belt load distribution device is worn, the lower back panel covers the small of the user's back, and the strap-like belt is fastened to secure the device in place. The gun belt, or other heavy utility-type belt, is worn normally, over the belt load distribution device. The load typically applied to the user's back, which often causes the development of severe, chronic back pain, is channeled outwardly away from the spine, and distributed comfortably across the muscles of the user's back.

The combination of these components in the preferred embodiment of the present invention provides an effective belt load distribution device in accordance with the objects outlined above. Its use in combination with a gun belt, tool belt, or other heavy occupational utility belt, enables much-welcomed pain-free daily employment for law enforcement officers, construction workers, and others.

DETAILED DESCRIPTION OF THE INVENTION

Figure 1:
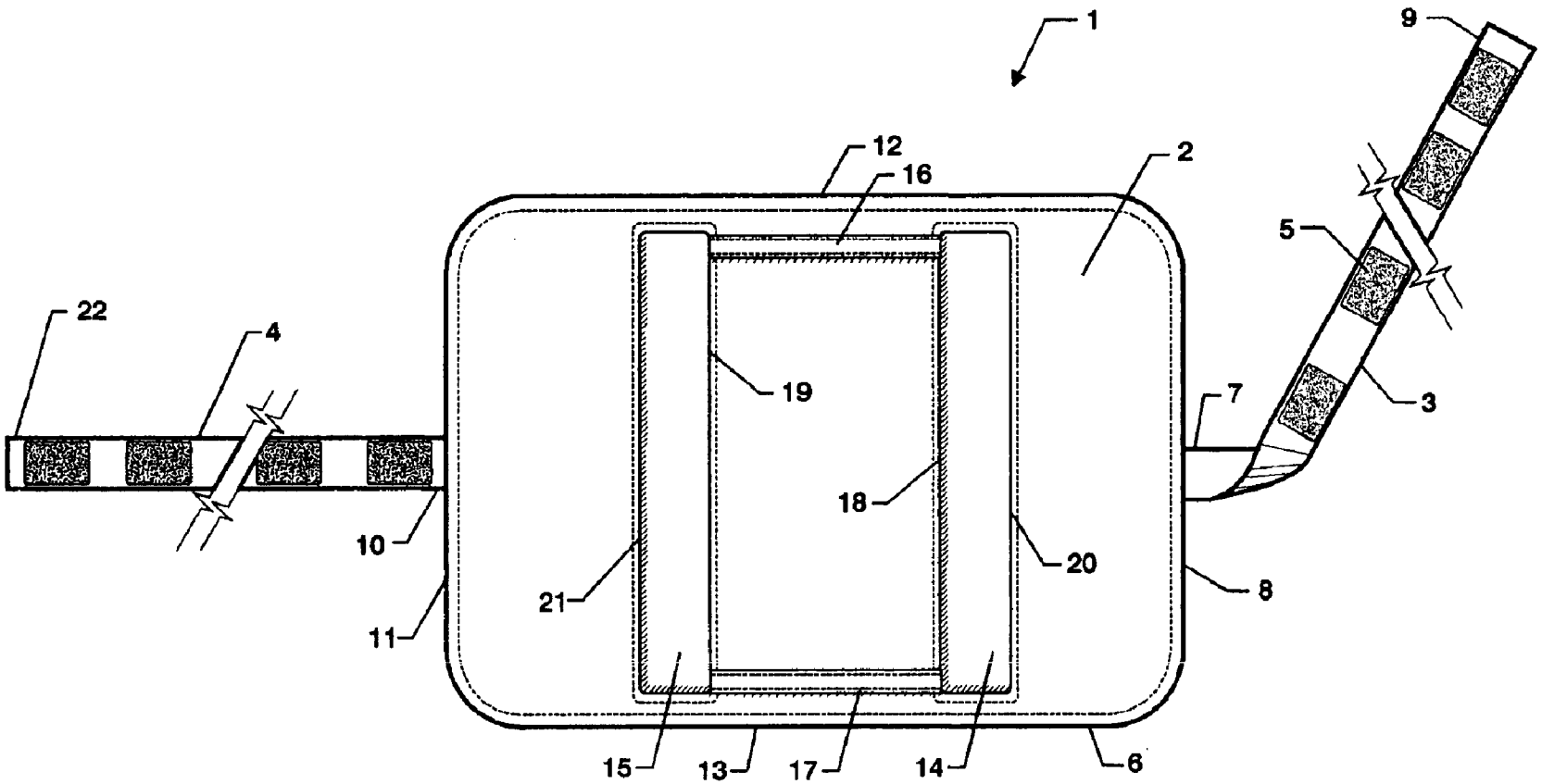
FIG. 1 is a plan view of an embodiment of the present invention, with the external side of the invention facing the reader.

Referring to FIG. 1, a plan view of one embodiment of the present invention is depicted. A completed embodiment of a belt load distribution device 1 is shown, lain flat on its internal surface, so that its external surface 2 is visible. The belt load distribution device 1 has a right strap 3 and a left strap 4. The right strap 3 has a fixed right end 7, attached to the right edge 8 of the lower back panel 6 of the device 1, and a free right end 9. The left strap 4 has a fixed left end 10, attached to the left edge 11 of the lower back panel 6, and a free left end 12. When right strap 3 and left strap 4 are attached to one another, e.g. using velcro 5 or other appropriate means of attachment, they form a belt which helps position and secure the device 1 about the waist of a user. When the device 1 is in use, the lower back panel 6 of the device 1 lays against the lower back of the user, with the internal surface of the device (not visible in this view) in contact with the user's lower back. The lower back panel 6, and its accompanying components, provides an effective means for distributing a belt load, and the straps (right strap 3 and left strap 4) combine to form a belt which provides a means for positioning and securing the device.

The lower back panel 6 is surrounded by its upper edge 12, right edge 8, lower edge 13, and left edge 11. The lower back panel 6 is fabricated from a lightweight, flexible, launderable, and comfortable material like cotton canvas. Other similar materials, such as cotton, linen, flannel, and denim are appropriate and suitable for fabricating the lower back panel 6.

The lower back panel 6 also has a right stay pocket 14 and a left stay pocket 15, inside each of which is housed a substantially rigid vertical stay. Near the upper edge 12 of the lower back panel 6, and preferably between the vertical stay pockets is an upper horizontal stay 16. Near the lower edge 13 of the lower back panel 6, and preferably between the vertical stay pockets is a lower horizontal stay 17. When the belt load distribution device 1 is in position for use on a user's lower back, the vertical stays cause a belt load, such as the load caused by wearing a heavy gun belt, to be directed away from the spine and distributed over the muscles of the user's back, thereby preventing chronic lower back pain. The horizontal stays maintain the shape of the lower back panel 6, preventing creasing and maintaining an appropriate distance between vertical stays (approximately four inches).

The preferable overall dimensions of the belt load distribution device are approximately nine inches from upper edge 12 to lower edge 13, and approximately twelve inches from left edge 11 to right edge 8. Right strap 3 and left strap 4 are each preferably approximately twenty-two inches long, although strap dimensions may vary significantly. Right strap 3 and left strap 4 may be made from a material similar to that of lower back panel 6, but are preferably elastic, enabling the device to comfortably fit the waistlines of a broad variety of users. Means for attachment of right strap 3 to left strap 4 is provided. Although many methods of attachment are appropriate (e.g. belt buckles, tie loops, clasps, etc.), Velcro hook and loop fastener is preferred for this embodiment. One surface of the right strap 3 is equipped with one Velcro hook and loop fastener component (e.g. the hook side), and the overlapping, mating surface of the left strap 4 is equipped with the other Velcro hook and loop fastener component, such that the two straps can be joined as a belt.

In order to fabricate an embodiment of the present invention, one begins with a substantially rectangular pattern of double-ply canvas fabric, approximately sixteen inches across by approximately nine inches. The pattern is placed horizontally, so that the longer dimension is in a left-to-right orientation. An approximate centerline is marked, about which approximately eight inches of material lies to the left and the same amount lies to the right. At approximately three inches from the centerline on both the right and left sides, a substantially vertical fold is made (folding the outward ends of the pattern inwardly toward the centerline). One-inch inward from each fold-line, a substantially vertical stitch is made from top to bottom of the pattern. The resulting flaps are then folded back outwardly, forming the right fixed fold-line 18 and the left fixed fold-line 19 shown in FIG. 1. Right stitch 20 and left stitch 21 are added to produce a partially completed, flat lower back panel 6 with right stay pocket 14 and left stay pocket 15.

Figure 2A:
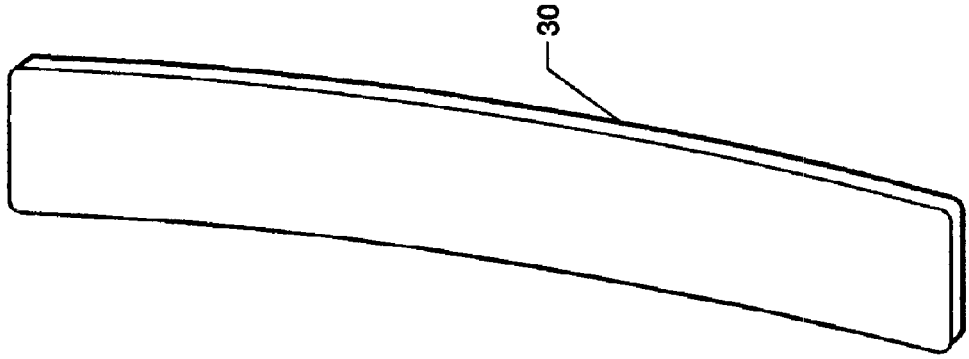
FIG. 2A is a three-dimensional representation of an embodiment of the vertical stay shown in FIG. 2, illustrating an example of suggested curvature to more comfortably and effectively fit the lower back of a wearer.
Figure 2:
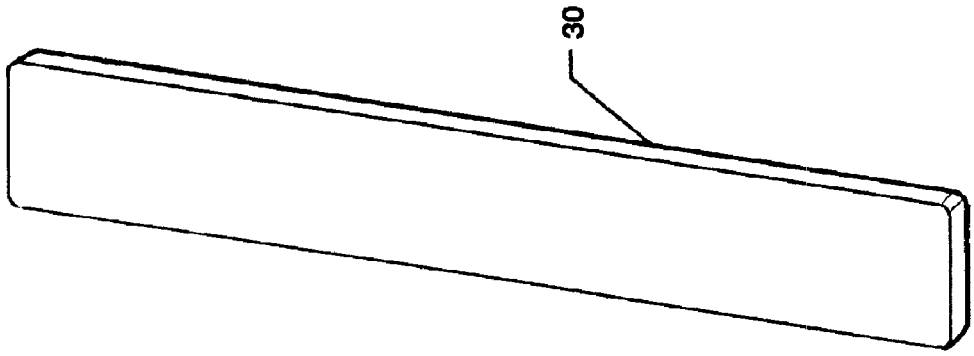
FIG. 2 is a three-dimensional representation of an embodiment of a vertical stay, which is a component of the present invention.

One substantially rigid vertical stay is inserted into each stay pocket. Each vertical stay is substantially rigid, but preferably has just enough flexibility to allow it to be conformed to a comfortable and effective curvature for its particular user. In the preferred embodiment of the present invention, the vertical stays are flat substantially rectangular aluminum pieces, measuring eight inches long, 0.75 (¾) inches wide, and one-eighth (⅛) inches thick. An example of an embodiment of one of the vertical stays 30 is illustrated in FIG. 2. An example of an embodiment of a vertical stay with slight curvature is shown in FIG. 2A. The corners of the vertical stays 30 are preferably slightly rounded, to improve comfort, and to prevent snagging, thereby increasing the life of the surrounding fabric. After the vertical stays have been inserted, they are secured by stitching the vertical stay pockets (referring back to FIG. 1, right stay pocket 14 and left stay pocket 15) closed on all sides, so that the vertical stays are substantially enclosed within the pockets.

Still referring to FIG. 1, two cotton covered plastic stays are stitched into the lower back panel 6 to help maintain its shape during use. Cotton covered plastic stays are available at typical fabric and sewing supply stores. The upper horizontal stay 16 is stitched into place near the upper edge 12 of the lower back panel 6, in a substantially horizontal orientation. The lower horizontal stay 17 is stitched into place near the lower edge 13 of the lower back panel 6, likewise in a substantially horizontal position.

To complete fabrication of the lower back panel 6, the upper edge 12, right edge 8, lower edge 13, and left edge 11 are preferably hemmed. The current embodiment of the present invention has ¼-inch hems. Corners are preferably rounded to improve comfort for the wearer. Right strap 3 and left strap 4 are sewn into right edge 8 and left edge 11, respectively. In the current embodiment, the fixed ends of the elastic straps (fixed right end 7 and fixed left end 10) are inserted between plies of canvas before right edge 8 and left edge 11 are finished with a surger. When the surging is completed the straps are securely attached at each edge.

Velcro tape is preferably stitched to surfaces of the right strap 3 and left strap 4 in locations that allow comfortable use of the belt load distribution device 1 by a variety of wearers. The current embodiment of the present invention uses strips of velcro ¾-inches wide by 1½ inches long, spaced at six-inch intervals. The current embodiment accommodates waist sizes from 18 to 90 inches. The belt is worn by fastening the elastic straps in the front only, or the straps can be doubled around the user's waist. The elastic straps are fastened at multiple intervals if desired, and the free ends of the right and left straps can be tied off if their length is unnecessary. Conversely, the device is designed and fabricated so that the strap length fits the user specifically. Varieties of strap design, geometry, material selection, and method of attachment are left to the imagination of one practiced in the skill of the art, and should be considered within the scope of the present invention.

Likewise, material selection and other design aspects of the lower back panel 6 may also vary considerably within the scope of the present invention. It should be noted, however, that significant testing has shown that a separation of approximately four inches between vertical stays in the right stay pocket 14 and the left stay pocket 15 provides maximum benefit to the user. A separation of two inches has been tested and found to be significantly less beneficial. A three-inch separation has been found to perform well, significantly better than the two-inch model. The four-inch model, however, has been shown to provide maximum relief in preventing heavy gun belt loads from applying pressure to the spine, and beneficially distributing such loads over the muscles of the user's back. Additionally, it has been shown that rounded corners on the lower back panel 6 provide more comfortable wear, tending less to fold over or to bunch up while in use, or to catch on clothing worn over or under the device.

Figure 3:
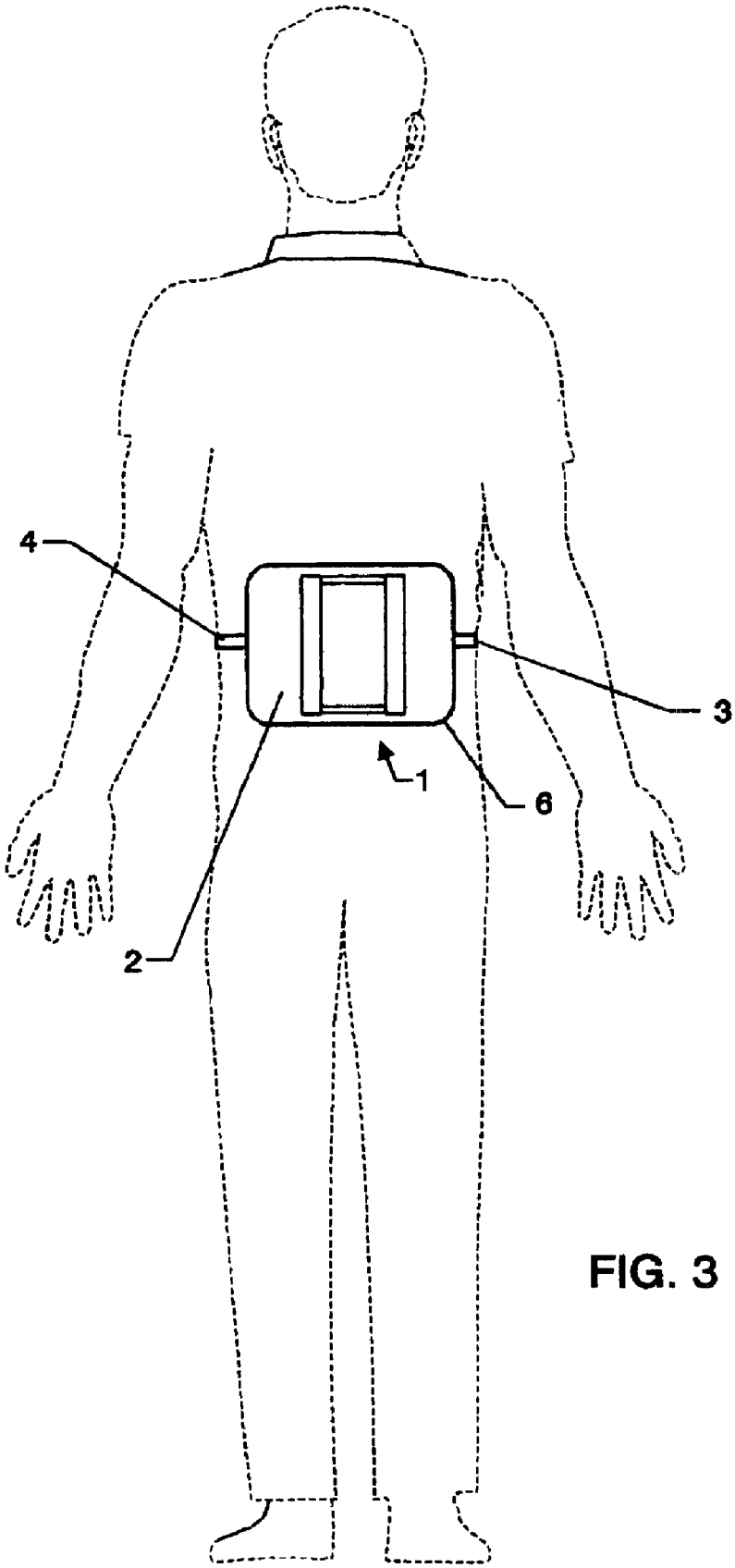
FIG. 3 is a depiction of one embodiment of the present invention being worn by a user.

Referring now to FIG. 3, one embodiment of the belt load distribution device 1 is depicted in use by a wearer. The belt load distribution device 1 is worn such that the lower back panel 6 is situated on the lower back of the wearer, with the external surface 2 of the device facing outwardly away from the wearer's lower back. Right strap 3 and left strap 4 wrap around the wearer's waist to form a belt, positioning and securing the device 1 in place.

Figure 4:
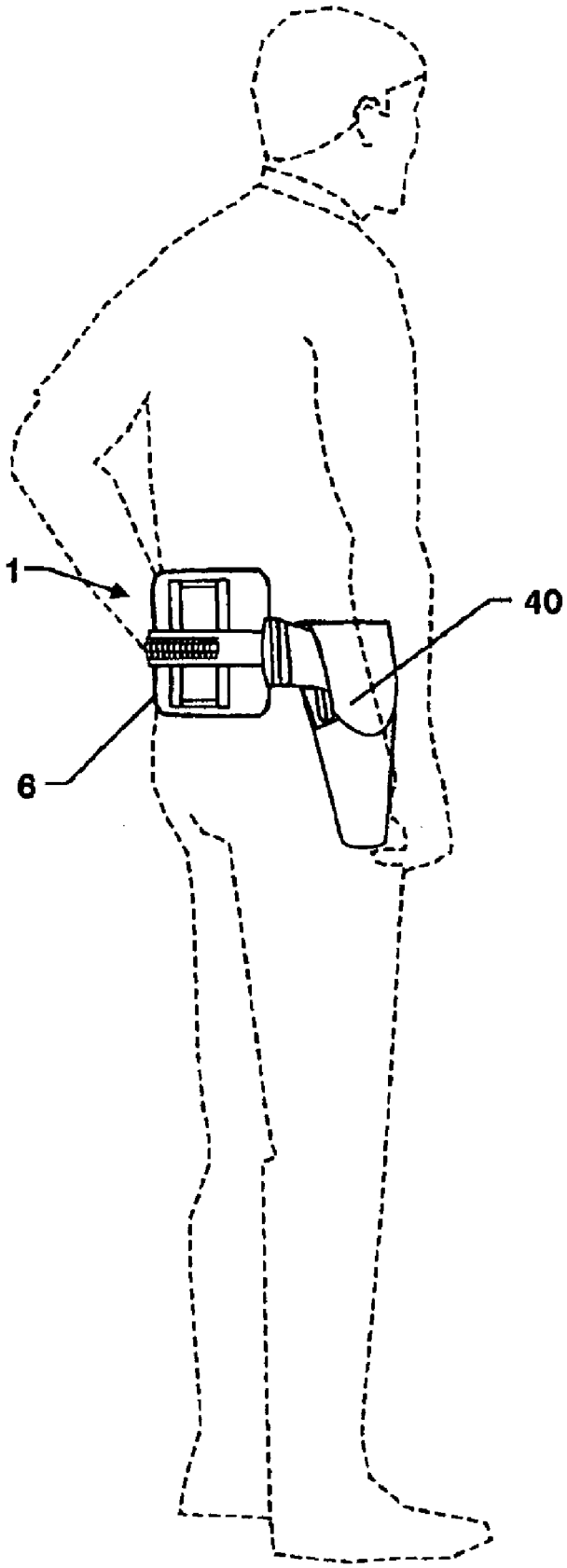
FIG. 4 is a depiction of one embodiment of the present invention, shown as worn in conjunction with a gun belt, to illustrate the interaction between the gun belt, which produces the belt load, and the present invention, which protects the wearer's back from the belt load.

Referring to FIG. 4, an embodiment of the belt load distribution device 1 is depicted in use by a wearer with a gun belt 40 also in place. The gun belt 40 (or tool belt, or other form of heavy utility belt) produces a belt load that would ordinarily affect the lower back of its wearer, resulting quite often in chronic back pain, especially after repeated daily wear. Due to the presence of the subject invention however, the belt load is applied instead to the lower back panel 6 of the belt load distribution device 1. As described above, the belt load is channeled away from the spine and distributed over the muscles of the wearer's back, thereby preventing the onset of lower back pain.

In summary, the above description of the present invention represents the invention in its preferred embodiment. It should be understood that changes in the details, materials, and component arrangements can be made by those skilled in the art, within the principle and scope of the invention as expressed in the appended claims. Although the invention has been described relative to a preferred embodiment, there are numerous variations and modifications that will be readily apparent to those skilled in the art in view of the above teachings. It is therefore to be understood that within the scope of the appended claims the invention may be practiced other than as specifically described.

The invention claimed is:

1. A belt load distribution device, comprising:

means for distributing a belt load, comprising a lower back panel having an upper edge, a lower edge, a right edge, and a left edge, and which is configured to house a plurality of vertical stays which are secured to the lower back panel in a vertical and symmetric orientation;

means for positioning and securing the means for distributing a belt load, which is configured to encircle a user's waist and which comprises a belt which is adjustable in length and has a right strap and a left strap, the right strap of the belt having a fixed right end which is fixedly attached to the right edge of the lower back panel, a free right end, and two substantially flat right strap surfaces; and the left strap of the belt having a fixed left end which is fixedly attached to the left edge of the lower back panel, and a free left end and two substantially flat left strap surfaces; the belt being substantially elastic and comprising hook and loop fastener strips which are attached to substantially flat right strap and left strap surfaces, thereby allowing the belt to be adjustably fastened;

the means for distributing a belt load being physically attached to the means for positioning and securing the means for distributing a belt load, and the means for distributing a belt load further comprising means for maintaining the shape of the lower back panel which is structurally fabricated into the lower back panel.

2. A belt load distribution device according to claim 1, wherein the means for maintaining the shape of the lower back panel comprises a horizontal stay, structurally attached to the lower back panel in a horizontal orientation.

3. A belt load distribution device according to claim 1, which additionally comprises means for producing a belt load which is physically configured to apply a belt load to the means for distributing a belt load.

4. A belt load distribution device according to claim 3, wherein the means for maintaining the shape of the lower back panel comprises a horizontal stay, attached to the lower back panel in a horizontal orientation.

5. A belt load distribution device according to claim 4, wherein the means for producing a belt load is a gun belt.

6. A belt load distribution device according to claim 4, wherein the means for producing a belt load is a tool belt.

7. A belt load distribution device according to claim 4, wherein the means for producing a belt load is a utility belt.

* * * * *